US008534638B2

(12) United States Patent
Alexander et al.

(10) Patent No.: US 8,534,638 B2
(45) Date of Patent: Sep. 17, 2013

(54) REMOVABLE GAS TURBINE ENGINE STAND

(75) Inventors: Eric J. Alexander, San Diego, CA (US); David Lau, San Diego, CA (US); David Eugene Martinez, Temecula, CA (US); Brian C. DeDe, San Diego, CA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 521 days.

(21) Appl. No.: 12/774,790

(22) Filed: May 6, 2010

(65) Prior Publication Data

US 2011/0272553 A1 Nov. 10, 2011

(51) Int. Cl.
*F16M 1/00* (2006.01)

(52) U.S. Cl.
USPC ..... 248/676; 248/352; 73/116.02; 269/47

(58) Field of Classification Search
USPC ..... 248/676, 637; 269/17, 70; 29/428; 212/179
See application file for complete search history.

(56) References Cited

U.S. PATENT DOCUMENTS

| | | | | | |
|---|---|---|---|---|---|
| 1,521,146 | A | | 12/1924 | Allen | |
| 2,356,864 | A | | 8/1944 | Martin et al. | |
| 2,412,488 | A | * | 12/1946 | Austin | 294/81.3 |
| 2,825,477 | A | * | 3/1958 | Ross | 29/559 |
| 2,931,644 | A | | 4/1960 | Kenworthy | |
| 2,957,665 | A | * | 10/1960 | Feiertag et al. | 248/606 |
| 3,868,101 | A | | 2/1975 | Nozaki et al. | |
| 4,151,822 | A | * | 5/1979 | Miura et al. | 123/195 A |
| 4,191,356 | A | * | 3/1980 | Ashmun et al. | 248/678 |
| 4,202,539 | A | | 5/1980 | Polastri et al. | |
| 4,239,196 | A | | 12/1980 | Hanger | |
| 4,431,223 | A | * | 2/1984 | Miller | 294/81.4 |
| 4,588,165 | A | | 5/1986 | Stellato et al. | |
| 4,796,861 | A | | 1/1989 | Petty | |
| 4,809,963 | A | * | 3/1989 | Kelly | 269/296 |
| 4,813,843 | A | * | 3/1989 | Gilmour et al. | 414/678 |
| 5,076,389 | A | * | 12/1991 | Goor | 180/232 |
| D324,599 | S | | 3/1992 | Bailey | |
| 5,139,233 | A | * | 8/1992 | Goss | 254/134 |
| 5,188,247 | A | * | 2/1993 | Jastrow | 212/343 |
| D368,187 | S | | 3/1996 | Johnson | |
| 5,851,007 | A | * | 12/1998 | Swartzlander et al. | 269/17 |
| 6,126,113 | A | | 10/2000 | Navickas | |
| 6,292,999 | B1 | * | 9/2001 | Rossway et al. | 29/559 |
| 6,318,699 | B1 | | 11/2001 | Williams | |
| 7,059,980 | B1 | * | 6/2006 | Shannon, Jr. | 473/494 |
| 7,909,300 | B2 | * | 3/2011 | Kidder et al. | 248/346.5 |
| 7,963,542 | B2 | * | 6/2011 | Doll et al. | 280/404 |
| 8,122,724 | B2 | * | 2/2012 | Slovisky et al. | 60/772 |
| 2008/0105638 | A1 | * | 5/2008 | Crawford et al. | 212/180 |

* cited by examiner

*Primary Examiner* — Terrell McKinnon
*Assistant Examiner* — Daniel J Breslin
(74) *Attorney, Agent, or Firm* — Carlson, Gaskey & Olds, PC

(57) ABSTRACT

A removable stand assembly for a gas turbine engine includes a first stand removably mountable to a gas turbine engine on one side of a center of gravity of the gas turbine engine and a second stand removably mountable to the gas turbine engine on a second side of the center of gravity of the gas turbine engine.

1 Claim, 8 Drawing Sheets

REMOVABLE GAS TURBINE ENGINE STAND

BACKGROUND

The present disclosure relates to an engine stand, and more particularly to a removable engine stand for a gas turbine engine.

There are various types of engine stands for use in connection with gas turbine engines. As an example, there are engine stands which include horizontally disposed rings which mount an engine such that the engine longitudinal axis extends generally vertical. Since the engine is effectively vertical, fluids may leak from the engines or be otherwise displaced.

In another type of engine stand, a generally horizontally disposed shaft extends through a vertical support member to mount the engine such that the engine longitudinal axis extends generally horizontally. Since the engine is effectively cantilevered, the engine may be subjected to a stress and force moment since the engine center of gravity is displaced from the vertical support.

Still another type of engine stand is the engine shipping container itself which may double as a stand. Although effective and tailored to the particular engine, the shipping container may have a relatively large volume and footprint.

Yet another type of engine stand is permanently attached to the engine for convenient maintenance operations. Since the engine stand is permanently attached, however, an overall weight increase results.

SUMMARY

A removable stand assembly for a gas turbine engine according to an exemplary aspect of the present disclosure includes a first stand removably mountable to a gas turbine engine on a first side of a center of gravity of the gas turbine engine and a second stand removably mountable to the gas turbine engine on a second side of the center of gravity of the gas turbine engine.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
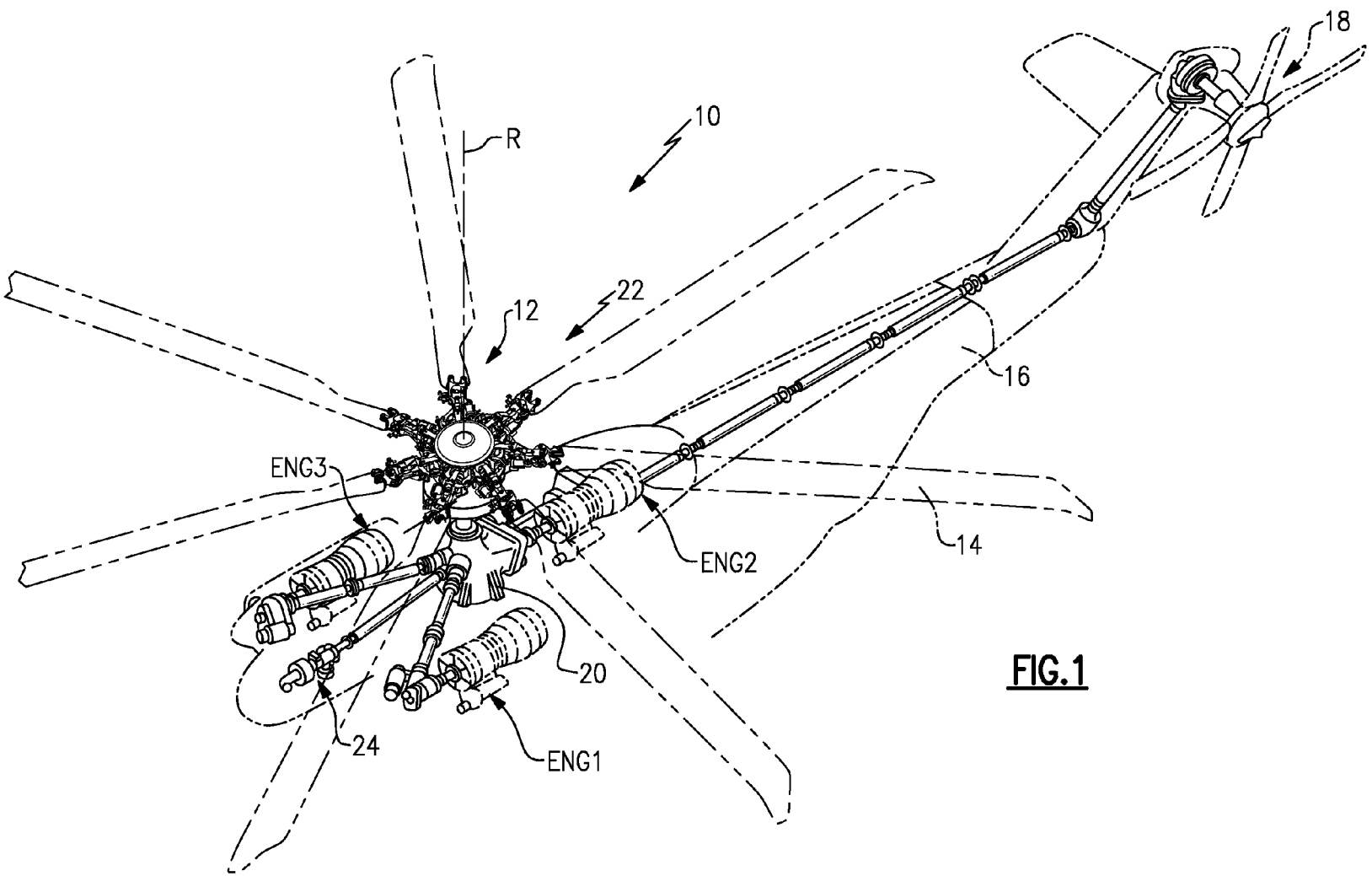
FIG. 1 is a partial phantom view of a rotary-wing aircraft illustrating a power plant system.

FIG. 1 schematically illustrates a rotary-wing aircraft 10 having a main rotor system 12. The aircraft 10 includes an airframe 14 having an extending tail 16 which mounts an anti-torque system 18. The main rotor system 12 is driven about an axis of rotation A through a main rotor gearbox (MGB) 20 by a multi-engine powerplant system 22—here having three engine packages ENG1, ENG2, ENG3 as well as an Auxiliary Power Unit (APU) 24. The engine packages ENG1, ENG2, ENG3 and APU 24 are example of gas turbine engines. The multi-engine powerplant system 22 generates the power available for flight operations and couples such power to the main rotor system 12 through the MGB 20. Although a particular helicopter configuration is illustrated and described in the disclosed embodiment, other configurations and/or machines, such as high speed compound rotary-wing aircraft with supplemental translational thrust systems, coaxial rotor system aircraft, turbo-props, tilt-rotor, fixed wing aircraft and non-aircraft applications such as ground vehicles will also benefit herefrom.

The multi-engine powerplant system 22 may require maintenance which requires removal of the engine packages ENG1-ENG3 or the APU 24. It should be understood that although the present disclosure will be described with reference to the APU 24 within the aircraft 10, any of the engine packages ENG1-ENG3 as well as other gas turbine engines within a powerplant system may also benefit herefrom.

Figure 2:
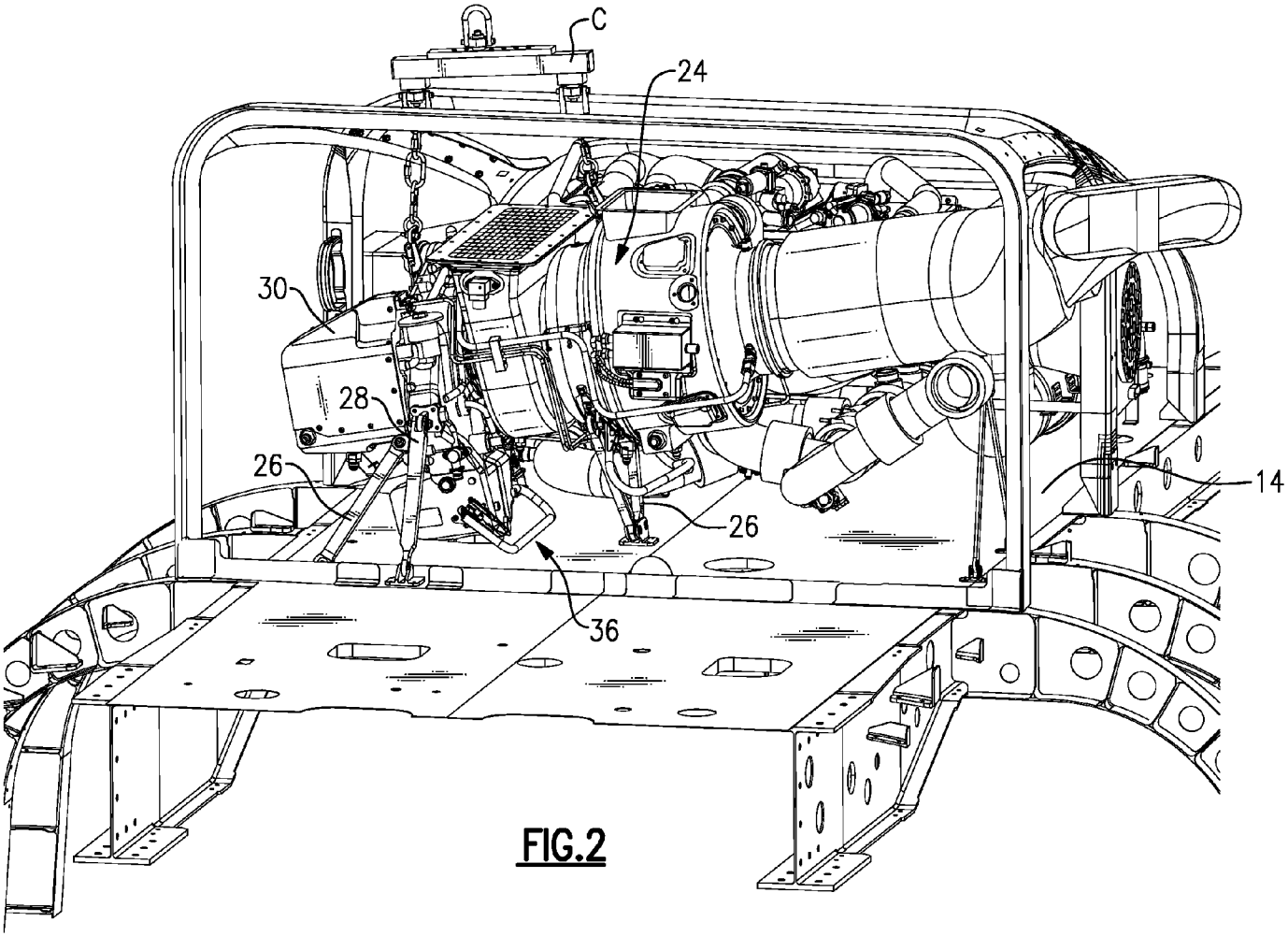
FIG. 2 is a general perspective view of a gas turbine engine Auxiliary Power Unit (APU) with the removable stand installed mounted within an airframe of the exemplary rotary wing aircraft embodiment with the removable stand installed.

Referring to FIG. 2, the APU 24 is mounted to the airframe 14 through attachments 26. Each attachment 26 is mounted to the APU 24 at respective mounting brackets 28 through removable fasteners 30 such as bolts. The APU 24 may thereby be removed (FIG. 3) with a crane C (illustrated schematically) attached to engine lift points 32 (also illustrated in FIG. 4). It should be understood that various attachments 26 and lift points 32 may alternatively be provided.

Figure 4:
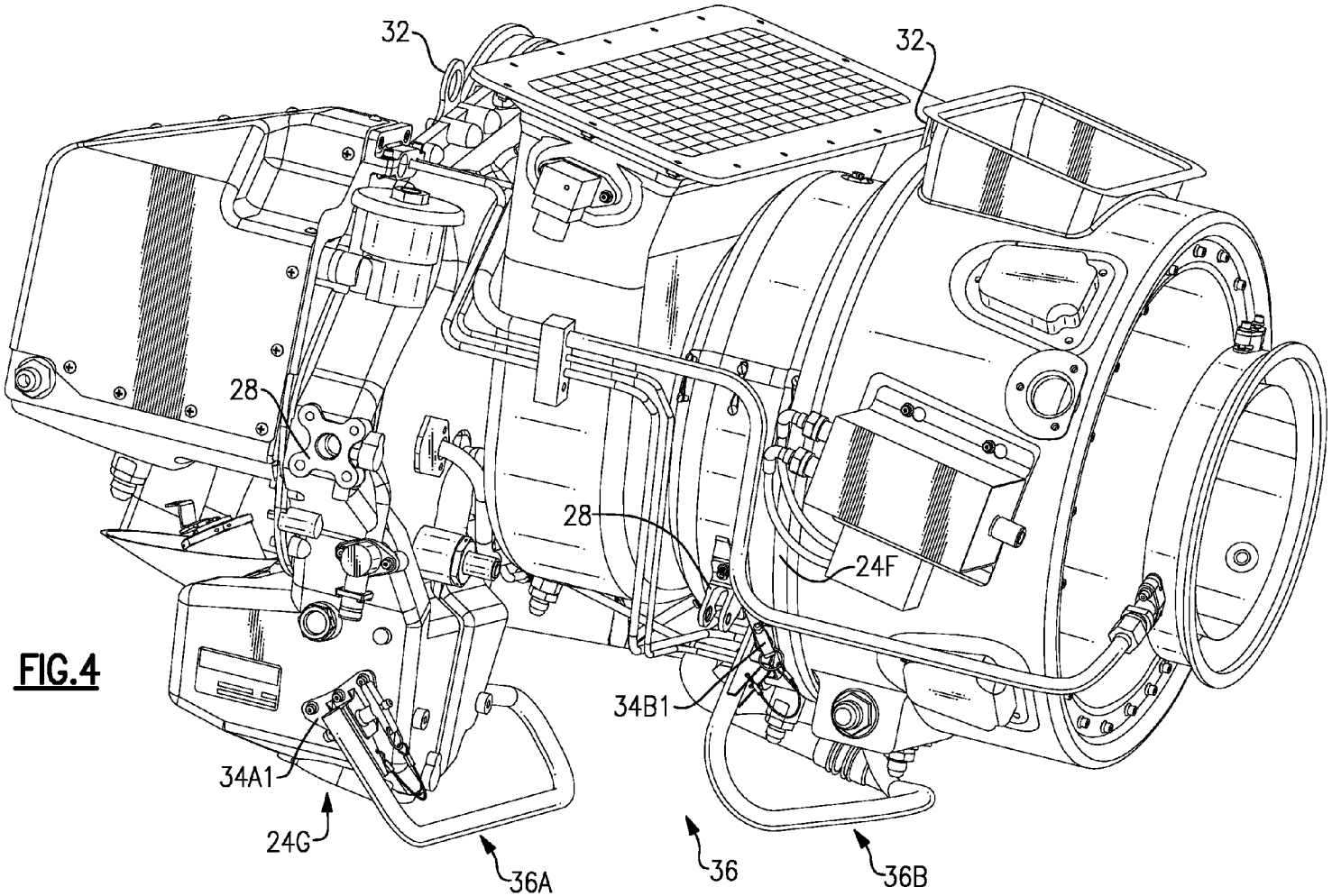
FIG. 4 is a general perspective view of the gas turbine engine APU with the removable stand installed.
Figure 7:
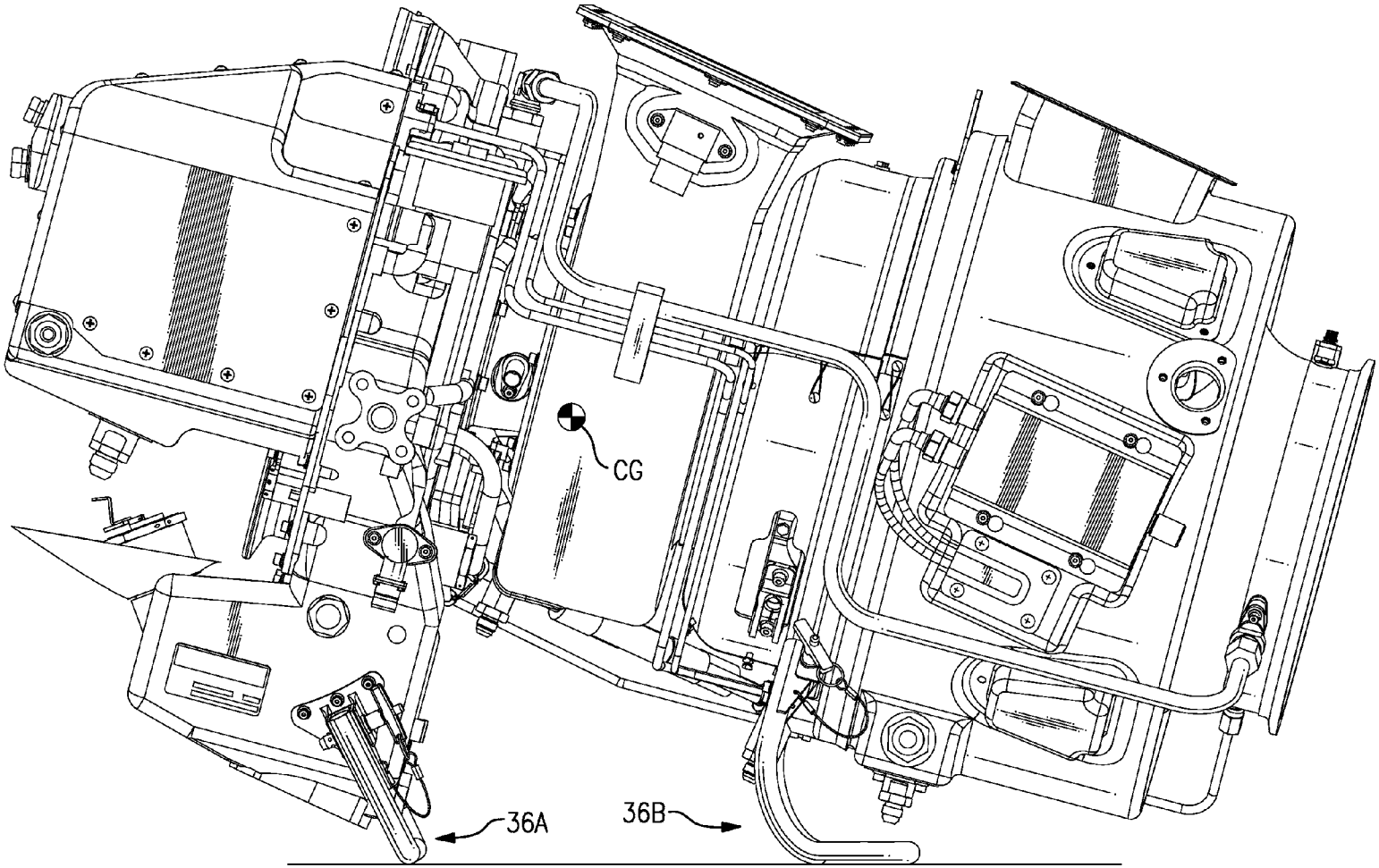
FIG. 7 is a side view of the gas turbine engine APU set upon a surface and rested upon the removable stand which straddles the gas turbine APU center of gravity.
Figure 8:
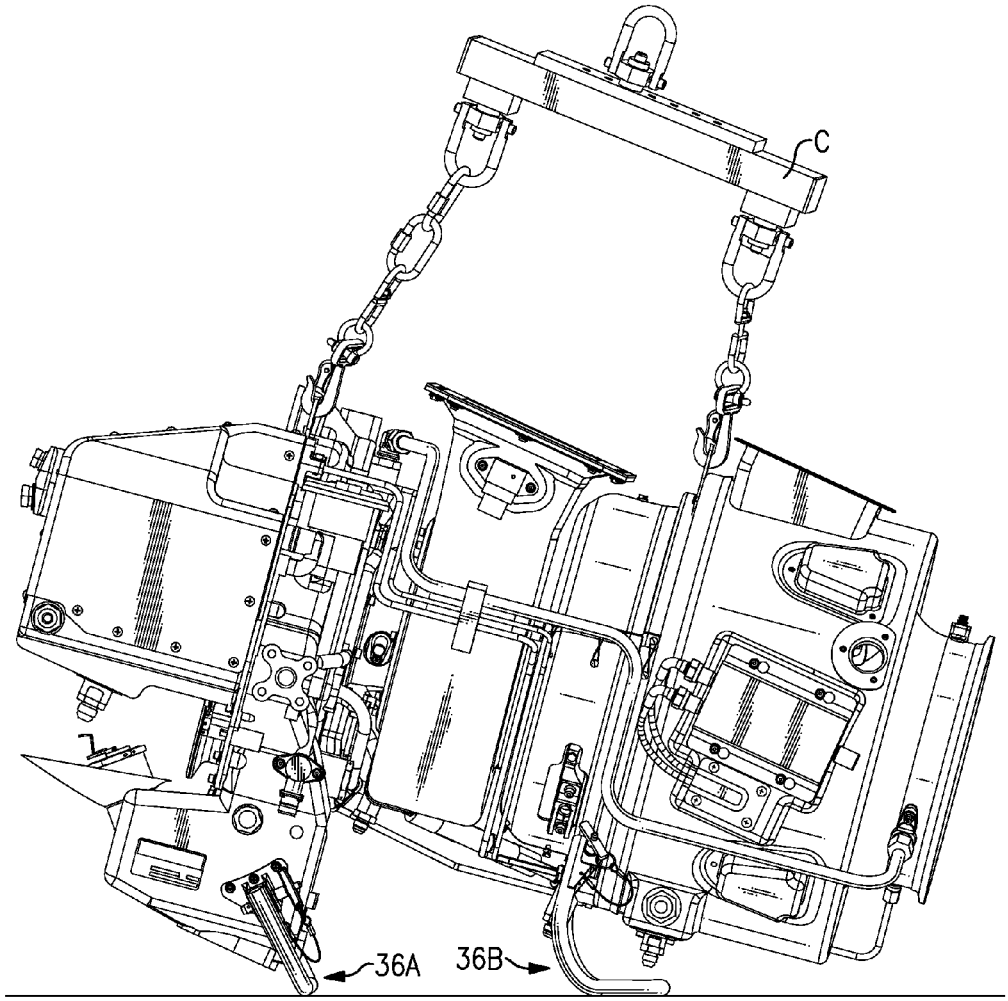
FIG. 8 is a side view of the gas turbine engine APU set upon a surface with a crane connected thereto.

Referring to FIG. 4, the APU 24 also includes engine stand brackets 34A1 34A2 (FIG. 5), 34B1, 34B2 (FIG. 6), which, as disclosed herein are mounted to an APU gearbox 24G and a combustor flange 24F. The engine stand brackets 34A1 34A2, 34B1, 34B2 may be defined at various positions but are generally located on either side of the APU Center of Gravity CG (FIG. 7) opposite the lift points 32 to facilitate placement upon a surface by crane C (FIG. 8).

The engine stand brackets 34A1 34A2, 34B1, 34B2 removably receive a respective stand 36A, 36B of a removable stand assembly 36 which is readily mounted to the APU 24 while the APU 24 is still mounted to the airframe 14 (FIG. 2). That is, the removable stand assembly 36 is readily attached to the APU 24 even when the APU 24 is in an operationally mounted position within the airframe 14. Although the removable stand assembly 36 disclosed in the non-limiting embodiment herein includes two stands 36A, 36B, it should be understood that only one stand or three or more stands may alternately be provided.

Figure 5:
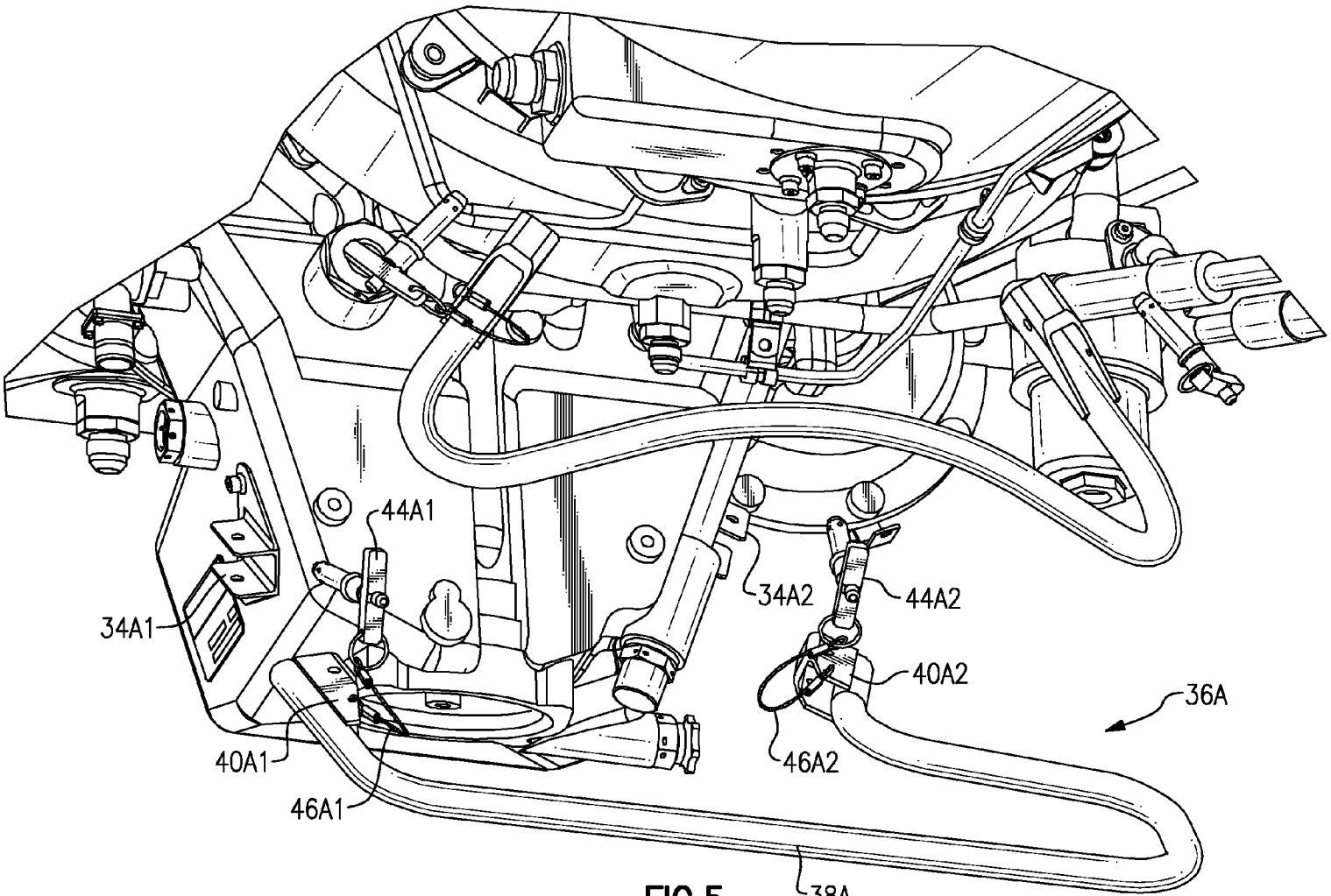
FIG. 5 is an exploded view of a first stand of the removable stand.
Figure 6:
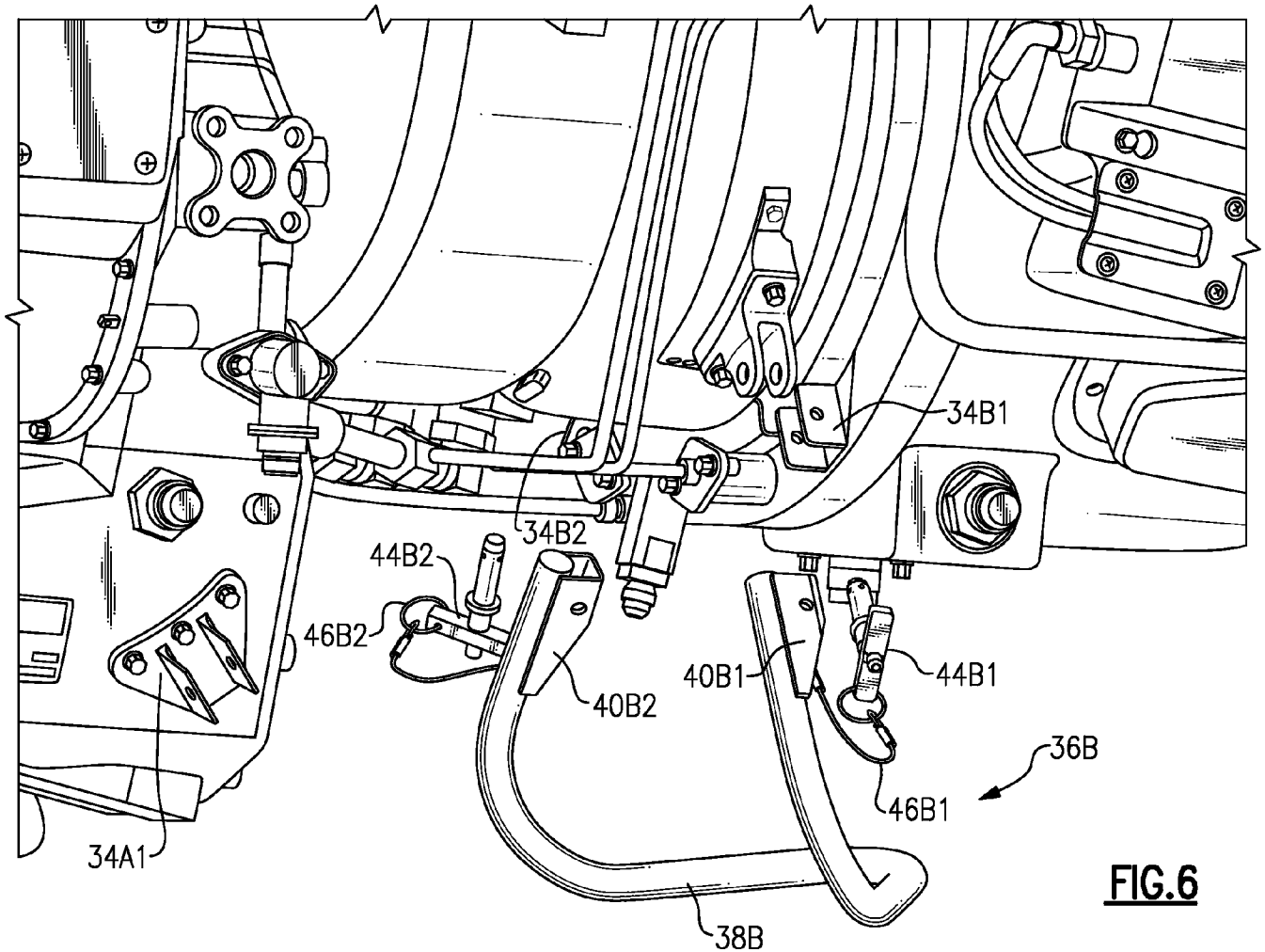
FIG. 6 is an exploded view of a second stand of the removable stand.

Referring to FIGS. 5 and 6, each stand 36A, 36B includes a support member 38A, 38B and a stand bracket 40A1 40A2, 40B1, 40B2 fixed to a distal end of each respective support member 38A, 38B. The support member 38A, 38B may be tubular, rectilinear, round or other shapes in cross-section and may be manufactured of various materials such as steel alloys, aluminum alloys and others to support the APU 24.

Each stand bracket 40A1, 40A2, 40B1, 40B2 is respectively attached to the engine stand brackets 34A1 34A2,

34B1, 34B2 with a quick disconnect pin 44A1 44A2, 44B1, 44B2. Each quick disconnect pin 44A1 44A2, 44B1, 44B2 may be tethered to the respective stand 36A, 36B with a respective tether 46A1 46A2, 46B1, 46B2 or other system to prevent loss thereof.

Each stand 36A, 36B is positioned on either side of the APU CG and is shaped to support the APU 24 upon a surface after removal from the aircraft (FIG. 9). In one non-limiting embodiment the stands 36A, 36B are shaped to maintain the APU 24 in the same attitude as when mounted in the aircraft to, for example, assure the fluids are retained in a desired operational level.

Figure 3:
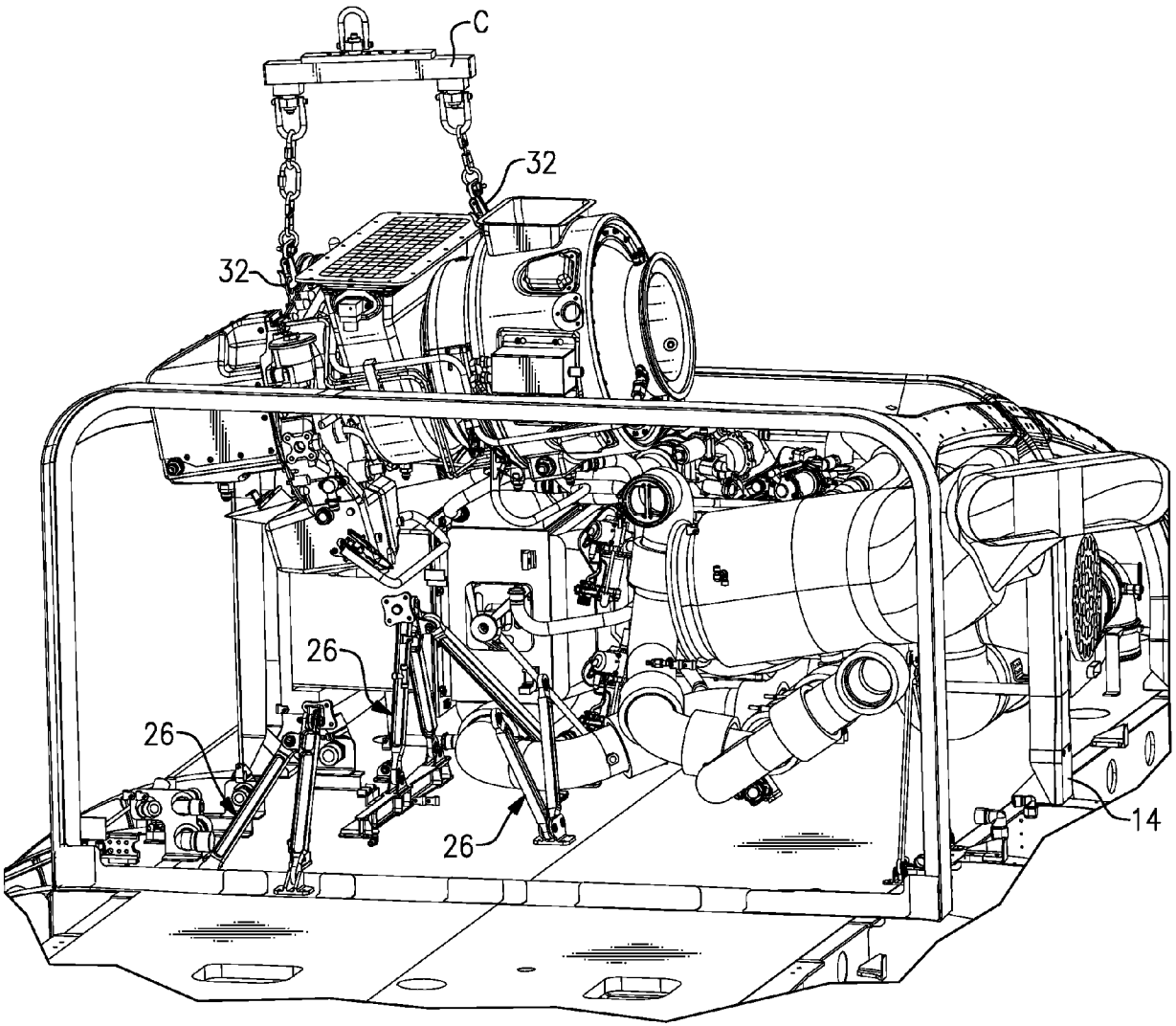
FIG. 3 is a general perspective view of the gas turbine engine APU with the removable stand installed partly removed from the exemplary rotary wing aircraft embodiment.

In operation, when the APU 24 must be removed and temporarily set down upon a surface, the removable stand assembly 36 is readily installed onto the APU 24—either while the APU 24 is within the aircraft or after removal therefrom when still attached to the crane C (FIG. 3). The removable stand assembly 36 may also be readily removed prior—or even after installation in the aircraft, hence, the weight of the removable stand assembly 36 is not carried in the design during flight.

Although a particular helicopter configuration is utilized to disclose maintenance of the APU 24, it should be further understood that various vehicles and systems which may require replacement or maintenance thereof such as ground carts, commercial airplanes and helicopters, military airplanes, LCAC landing craft, tanks etc., will also benefit herefrom.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A removable stand assembly for a gas turbine engine comprising:

a first stand removably mountable to a gas turbine engine on a first side of a center of gravity of the gas turbine engine;

a second stand removably mountable to the gas turbine engine on a second side of the center of gravity of the gas turbine engine;

wherein said first stand and said second stand are removably mountable generally opposite a lift point of the gas turbine engine, said first stand including a first support member, a first stand bracket at a first end section of said first support member, and a second stand bracket at a second end section of said first support member, said first stand including a first pin assembly engageable with said first stand bracket, and a second pin assembly engageable with said second stand bracket; and said first pin assembly being tethered to said first stand bracket and said second pin, assembly being tethered to said second stand bracket.

* * * * *